US007258099B2

(12) United States Patent
Yoshida et al.

(10) Patent No.: US 7,258,099 B2
(45) Date of Patent: Aug. 21, 2007

(54) INTERNAL COMBUSTION ENGINE CONTROL METHOD

(75) Inventors: Takashi Yoshida, Chiyoda-ku (JP); Toshiharu Nogi, Chiyoda-ku (JP); Noboru Tokuyasu, Chiyoda-ku (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/920,252

(22) Filed: Aug. 18, 2004

(65) Prior Publication Data

US 2005/0087169 A1 Apr. 28, 2005

(30) Foreign Application Priority Data

Oct. 22, 2003 (JP) ..... 2003-361394

(51) Int. Cl.
*F02D 43/00* (2006.01)

(52) U.S. Cl. ..... 123/299; 123/182.1; 123/305

(58) Field of Classification Search ..... 123/299, 123/182.1, 179.3, 179.4, 179.5, 491, 305
See application file for complete search history.

(56) References Cited

U.S. PATENT DOCUMENTS 4,528,963 A * 7/1985 Bessho et al. ..... 123/491
2004/0000282 A1* 1/2004 Kataoka et al. ..... 123/182.1
2004/0055553 A1* 3/2004 Asaka et al. ..... 123/179.3

FOREIGN PATENT DOCUMENTS

JP 2002-4985 1/2002

* cited by examiner

*Primary Examiner*—Stephen K. Cronin
*Assistant Examiner*—Arnold Castro
(74) *Attorney, Agent, or Firm*—Crowell & Moring LLP

(57) ABSTRACT

Satisfactory restartability has not been obtained so far because the timing of opening an exhaust valve of a cylinder under expansion stroke is adjusted for improvement of startability and a valve adjusting mechanism is always controlled in the same manner regardless of the engine status at start. In the invention, control is performed to adjust the timing of closing an intake valve so that an effective compression ratio of a cylinder under compression stroke reduces. Also, the effective compression ratio of the compression stroke cylinder is decided based on a piston position at engine restart. By varying the intake valve closing timing in the expansion stroke cylinder to reduce the effective compression ratio depending on the engine status at restart, it is possible to lessen a load imposed on a starter when the engine is restarted, and to improve startability without complicating the engine system.

24 Claims, 14 Drawing Sheets

INTERNAL COMBUSTION ENGINE CONTROL METHOD

BACKGROUND OF THE INVENTION

1. Field of the Invention

The present invention relates to an internal combustion engine control method, and more particularly to a control method for an engine when the engine is restarted.

2. Description of the Related Art

In JP-A-2002-4985, at restart of an internal combustion engine, fuel injection and ignition are performed in a cylinder under expansion stroke to start the engine with combustion made in that cylinder. Further, the timing of opening an exhaust valve of the cylinder under expansion stroke is varied to increase an expansion ratio with intent to increase work generated by the combustion and to improve startability.

SUMMARY OF THE INVENTION

In the above-described related art, a valve adjusting mechanism is always controlled in the same manner regardless of the engine status at start. In addition, the valve adjusting mechanism controls an exhaust valve, and therefore satisfactory startability cannot be obtained (namely, a load imposed on a starter cannot be so reduced).

According to a first aspect of the present invention, when an internal combustion engine is restarted, the timing of closing an intake valve of a cylinder under compression stroke is adjusted by a valve adjusting mechanism so that compression work performed by the cylinder under compression stroke is smaller than combustion work performed by a cylinder under expansion stroke.

According to a second aspect of the present invention, a fuel injection amount, a time from fuel injection to ignition, and/or fuel divided injection are controlled in accordance with start environment parameters at engine restart.

According to a third aspect of the present invention, fuel injection is performed in the cylinder under expansion stroke prior to restart after stop of the engine.

The present invention is able to reduce a load imposed on a starter at engine restart.

DESCRIPTION OF THE PREFERRED EMBODIMENTS

Preferred embodiments of the present invention will be described below.

In the related art, it is proposed to adjust the timing of opening the exhaust valve of the cylinder under expansion stroke for an improvement of startability. Also, the valve adjusting mechanism is always controlled in the same manner regardless of the engine status at start. For those reasons, re-startability cannot be satisfactorily improved.

In contrast, the following embodiments are featured in making control such that the timing of closing an intake valve is adjusted to reduce an effective compression ratio of a cylinder under compression stroke. Further, the effective compression ratio of the compression stroke cylinder is decided based on a piston position at engine start.

First Embodiment

A first embodiment of the present invention will be described below with reference to the drawings.

Figure 1:
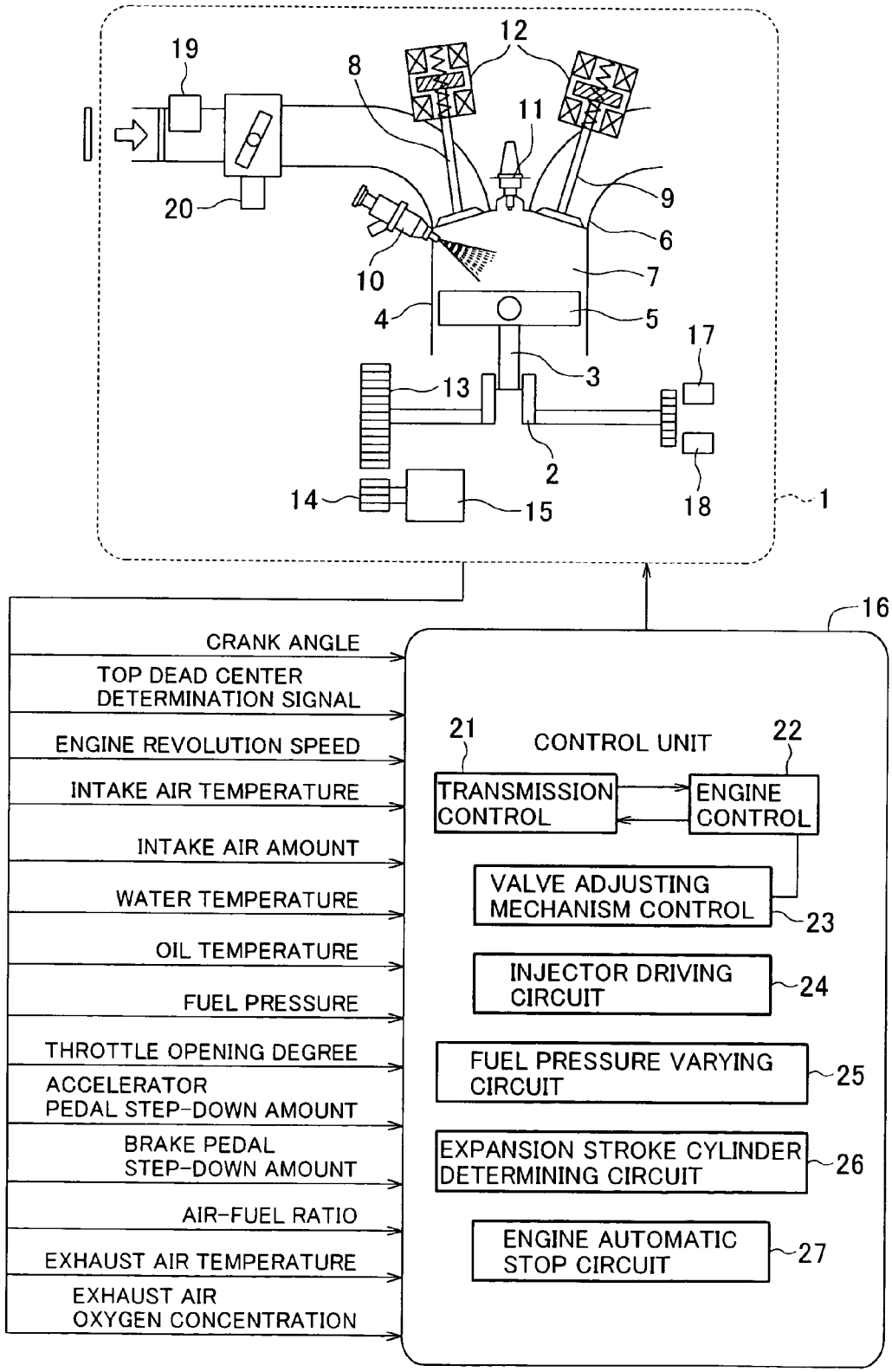
FIG. 1 is a system diagram of an internal combustion engine according to a first embodiment of the present invention.

FIG. 1 is a system diagram of an in-cylinder direct injection internal combustion engine according to the first embodiment of the present invention. An internal combustion engine 1 shown in FIG. 1 includes a crank mechanism 2. A connecting rod 3 coupled to the crank mechanism 2 converts a reciprocating motion of a piston 5 into a rotary motion, the piston 5 being slidably fitted in a cylinder 4. A combustion chamber 7 is formed in a cylinder head 6, and the cylinder head 6 is provided with an intake valve 8, an exhaust valve 9, a fuel injection valve 10, and a spark igniter 11. Each of the intake valve 8 and the exhaust valve 9 includes a valve adjusting mechanism 12 capable of varying the timings of opening and closing the valve. The engine 1 takes air for burning into the combustion chamber 7 that is brought under negative pressure with the reciprocating motion of the piston 5. Fuel supplied to the engine 1 is directly injected into the combustion chamber 7 from the fuel injection valve 10. The fuel injected into the combustion chamber 7 is mixed with the air taken into the combustion chamber 7, and a resulting mixture is burnt with the spark igniter 11. Exhaust gas is exhausted through the exhaust valve 9 with the reciprocating motion of the piston 5. A flywheel 13 is attached to one end of the crank mechanism 2. When starting the engine by using a starter 15, the starter 15 is coupled to the flywheel 13 through a starter gear 14.

A control unit 16 detects the operation status of the engine 1 based on signals outputted from various sensors, and controls the valve adjusting mechanism 12, the fuel injection valve 10, and the spark igniter 11, which are associated with the engine 1, in accordance with the detection result.

The following signals are inputted to the control unit 16 from the various sensors. In this embodiment, the signals inputted to the control units 16 represent a crank angle, a top dead center determining signal, a throttle opening degree, an accelerator pedal step-down amount, a brake pedal step-down amount, an engine revolution speed, an intake air temperature, an intake air amount, a water temperature, an oil temperature, a fuel pressure, an air-fuel ratio, an exhaust air temperature, and an exhaust air oxygen concentration. Only a crank angle sensor 17, a top dead center determining sensor 18, an intake air amount sensor 19, and a throttle opening degree sensor 20 are shown in FIG. 1.

The control unit 16 comprises a transmission control unit 21 for controlling a transmission (not shown), an engine control unit 22, a valve adjusting mechanism control unit 23, an injector driving circuit 24, a fuel pressure varying circuit 25, an expansion stroke cylinder determining circuit 26, an engine automatic stop circuit 27, etc.

The valve adjusting mechanism 12 capable of varying the timings of opening and closing each of the intake valve 8 and the exhaust valve 9 is constituted as a varying mechanism using an electromagnetic actuator. Thus, the valve adjusting mechanism 12 is able to control the opening/-closing timings of the intake valve 8 and the exhaust valve 9, as desired, within a predetermined range for each cylinder.

The timings of the fuel injection and the ignition for each cylinder are controlled by the control unit 16. More specifically, the fuel injection valve 10 and the spark igniter 11 are driven respectively by an injection pulse signal and an ignition signal outputted from the control unit 16. The injection pulse signal and the ignition signal are obtained from respective outputs of the crank angle sensor 17 and the top dead center determining sensor 18, both associated with the engine 1, through processing in the control unit 16, so that they can properly control the timings of fuel injection and ignition. In consideration of backward rotation of a crankshaft caused upon stop of the engine, the crank angle sensor 17 preferably has the function of measuring a rotational angle of the crankshaft in both forward and backward directions like a resolver that is capable of measuring an absolute angle of the crankshaft. Also, in this first embodiment of the present invention, the crankshaft angle is measured as follows. The top dead center determining sensor 18 is set in advance so as to output a signal in match with, e.g., the top dead center of a particular stroke of a particular cylinder. Then, by counting and storing, in the control unit 16, the signals from the crank angle sensor 17 during a period between two output signals from the top dead center determining sensor 18, the stroke and the piston position can be determined for each cylinder. Further, when the engine 1 is stopped, it is possible to determine the stroke of the particular cylinder and the piston stop position therein at that time by storing the stroke of each cylinder with the stroke determining means provided for each cylinder just before stop of the engine.

The operation of this embodiment will be described below.

Figure 2:
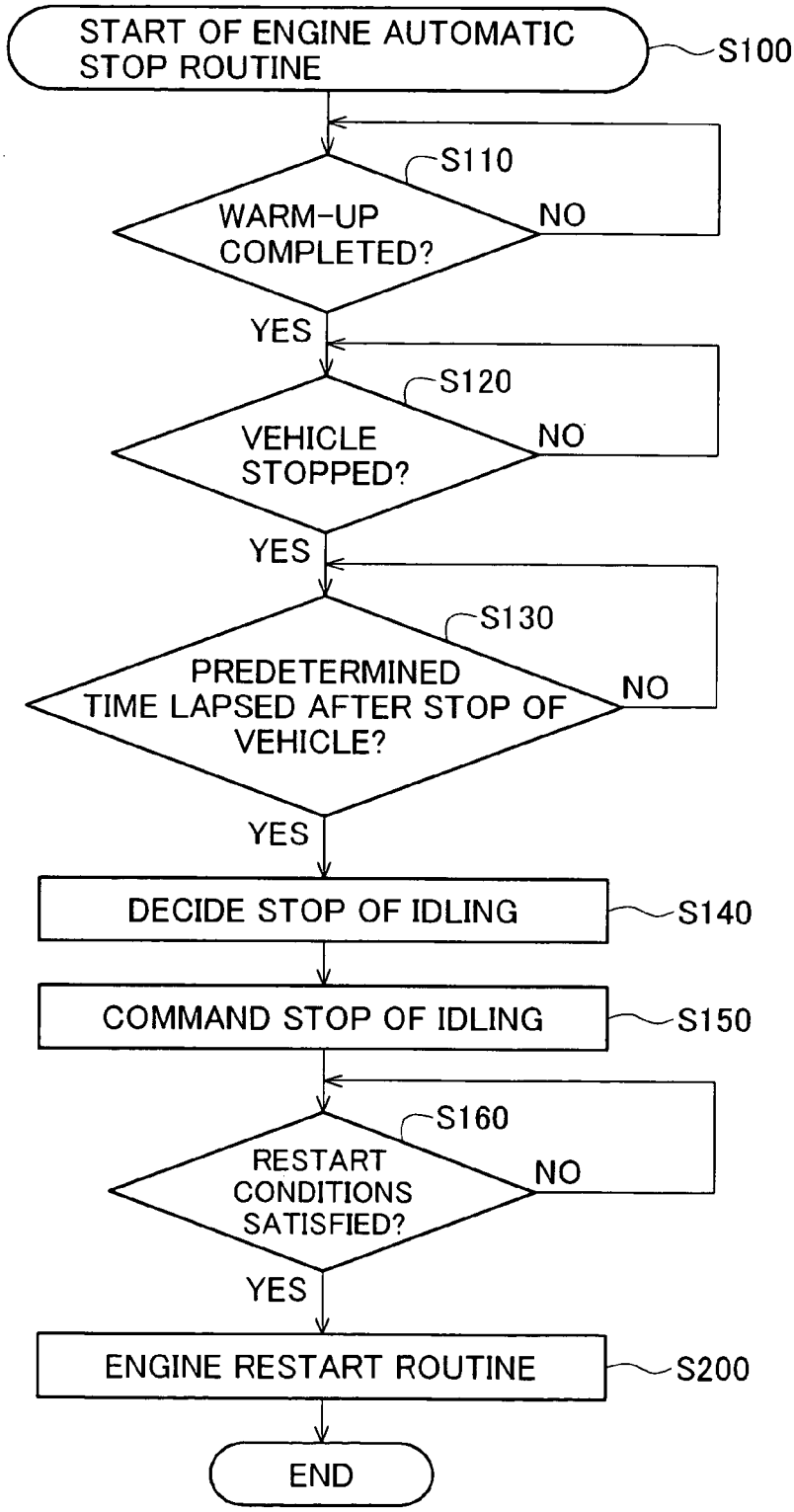
FIG. 2 is a chart showing control flow of an engine automatic stop routine in the first embodiment of the present invention.

FIG. 2 shows control flow of an engine automatic stop routine. The control unit determines in S110 whether warm-up of the engine is completed. In this embodiment, when the water temperature is not lower than 80° C., the control unit determines that the warm-up is completed, and when the water temperature is lower than 80° C., it determines that the engine is in a cold state. However, the temperature used in that determination may be set to any other suitable value. If it is determined in S110 that the warm-up is completed, the control unit determines in S120 whether the relevant vehicle is stopped. If the vehicle is stopped, the control unit determines in S130 whether a predetermined time has lapsed from the stop of the vehicle. If the predetermined time has lapsed from the stop of the vehicle, stop of idling is decided in S140, followed by commanding the stop of idling in S150. After the stop of idling has been commanded in S150 and the command of the fuel injection or the ignition for an optionally selected cylinder has ceased, 4-stroke operation having been performed so far may be changed to 2-stroke operation by varying the valve timing decided in the valve adjusting mechanism 12 using the electromagnetic actuator. With that operation mode change, through compression work produced by repeating the intake stroke and the compression stroke, the piston stop position can be feedback-controlled to a desired position in all the cylinders based on an output of the above-mentioned means for determining the piston stop position. Instead of the valve adjusting mechanism 12 using the electromagnetic actuator, an auxiliary, e.g., an air conditioner, an alternator or a defroster, may be driven to feedback-control the piston stop position to the desired position. Further, any other mechanism capable of mechanically stopping the crankshaft may also be used. Even in the case where, after the engine stop, the vehicle is moved by motive power obtained from a power source other than the engine and the piston stop position in the expansion stroke cylinder is shifted, because electric power is continuously supplied to the control unit 16 during the stop of idling, the piston stop position in the expansion stroke cylinder can be determined. Then, before engine restart conditions are satisfied, the fuel injection may be performed in the expansion stroke cylinder that is detected by the above-mentioned stroke determining means associated with the optionally selected cylinder. Such fuel injection is advantageous in that fuel is sufficiently evaporated within the combustion chamber at restart of the engine and therefore a more homogeneous fuel-air mixture can be formed. As a result, startability can be improved. Any other suitable condition may be added to the conditions used for deciding the stop of idling. If it is determined in S160 after the engine stop that the restart conditions are satisfied, an engine restart routine is started in S200.

Figure 3:
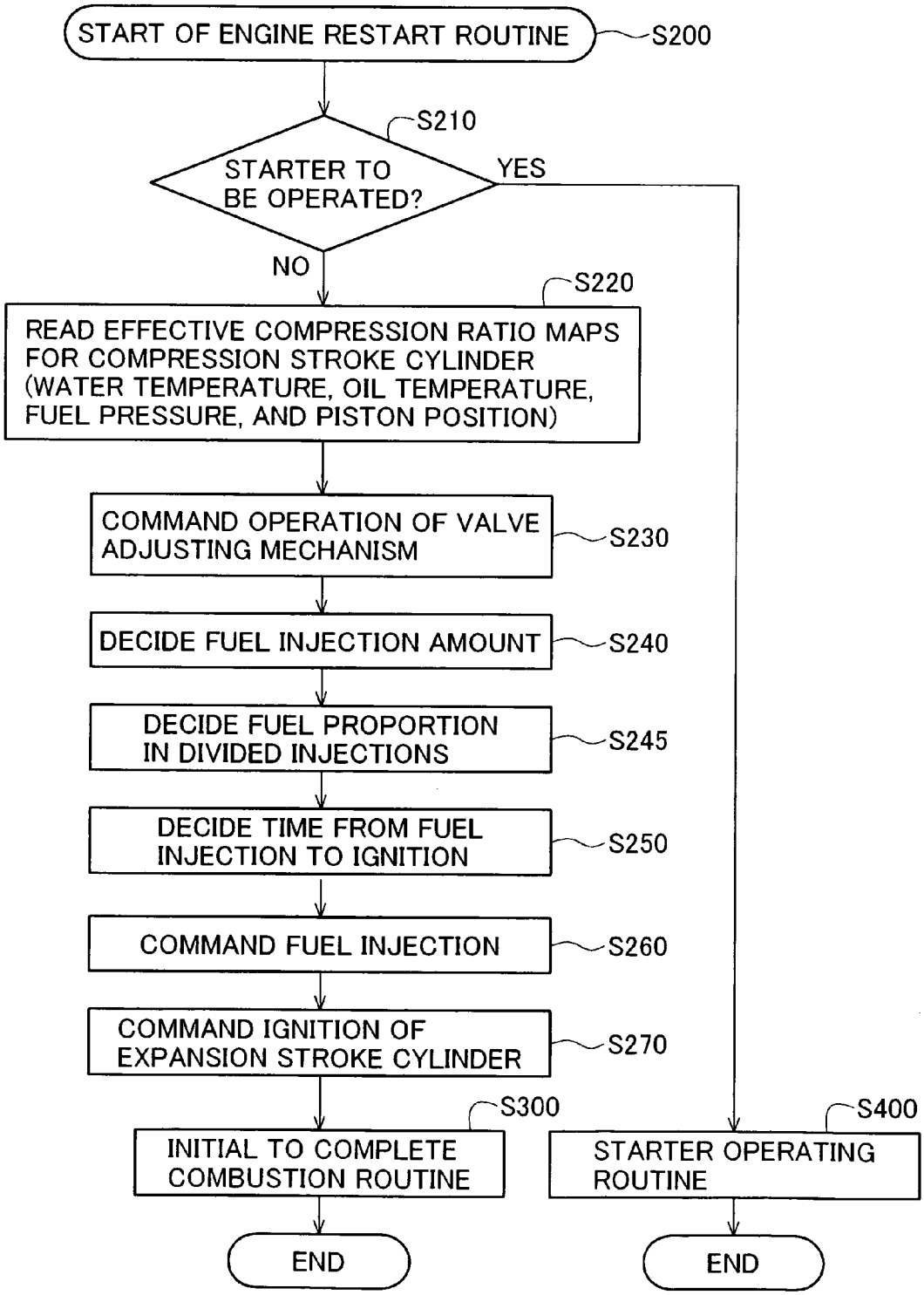
FIG. 3 is a chart showing control flow of an engine restart routine in the first embodiment of the present invention.
Figure 4:
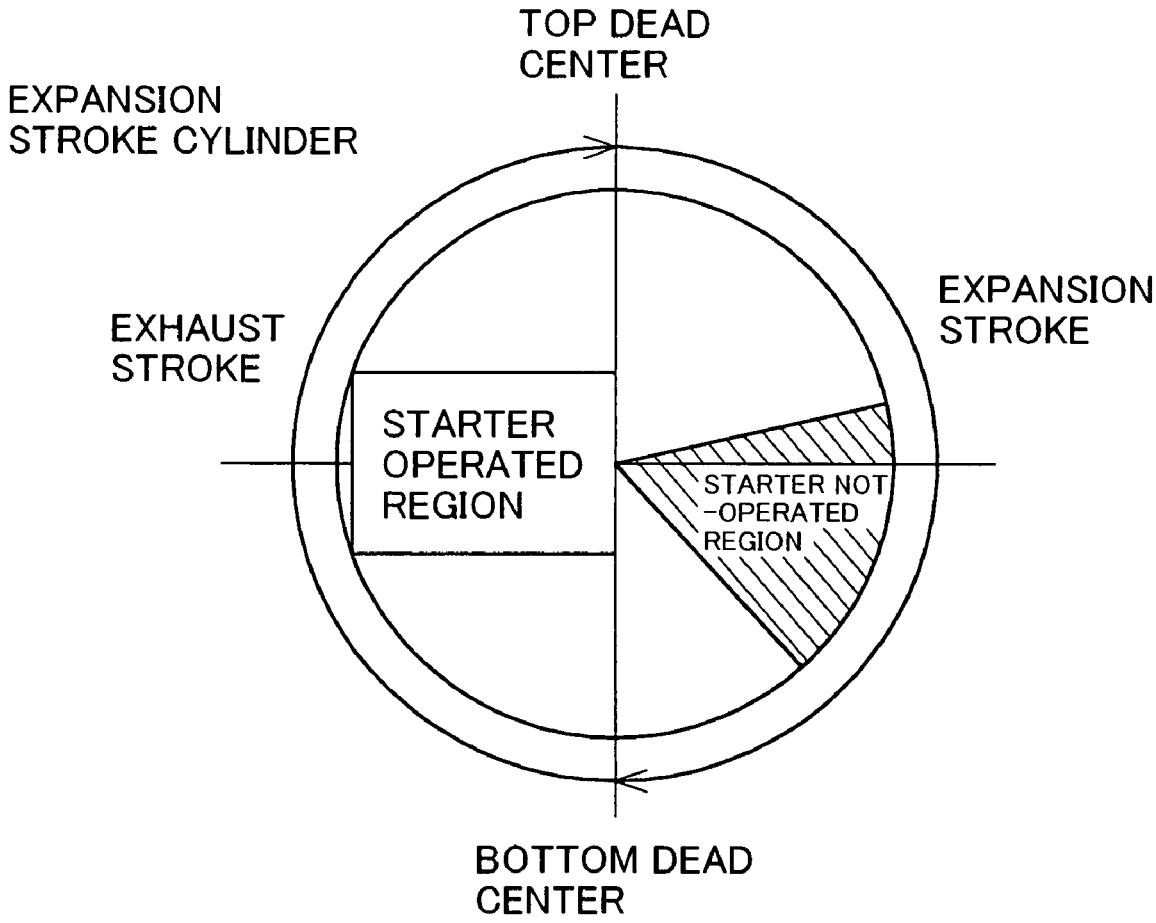
FIG. 4 shows a starter not-operated region depending on a piston position in the first, second and third embodiments of the present invention.

FIG. 3 shows control flow of the engine restart routine. This routine represents control flow of from engine restart to initial combustion. Based on at least the piston position in the expansion stroke cylinder at restart, the control unit determines in S210 whether the starter is to be operated or not. For example, the control unit may determine that the starter is not to be operated, if the battery remaining level is lower than a predetermined value. In this embodiment, if the piston position in the expansion stroke cylinder falls within a preset region as shown in FIG. 4, it is determined that the starter is not to be operated. More specifically, the starter is not to be operated within the region of 80° to 130° in the expansion stroke after the top dead center. This is because it has been experimentally confirmed that a torque sufficient for start can be obtained in the above-mentioned range of the piston position. In addition to the piston position, the water temperature, the oil temperature and/or the fuel pressure may also be used to determine whether the starter is to be operated or not. Further, whether the starter is to be operated or not may be determined based on any of map information obtained from the GPS, a steering angle, a winker-on, and a time from brake release to step-down of an accelerator pedal. This provides the failsafe function of avoiding a start failure when the engine is restarted from the idling stop state in the case of turning to the right at an intersection, for example. If it is determined based on any of the map information obtained from the GPS, the steering angle, the winker-on, and the time from brake release to step-down of the accelerator pedal that the driver is going to turn to the right, the starter may be always operated. Additionally, when the above-described feedback control of the piston stop position is performed by the valve adjusting mechanism 12 using the electromagnetic actuator or by any of the auxiliaries when the engine is stopped, the determination in S210 regarding the operation of the starter with respect to the piston stop position is not made because the piston can be stopped at the piston stop position where the starter is not to be operated.

Figure 5:
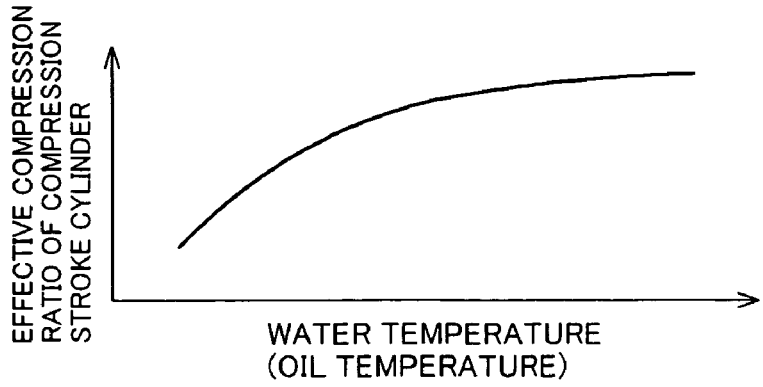
FIG. 5 is a graph showing an effective compression ratio of a compression stroke cylinder with respect to water temperature in the first and second embodiments of the present invention.
Figure 6:
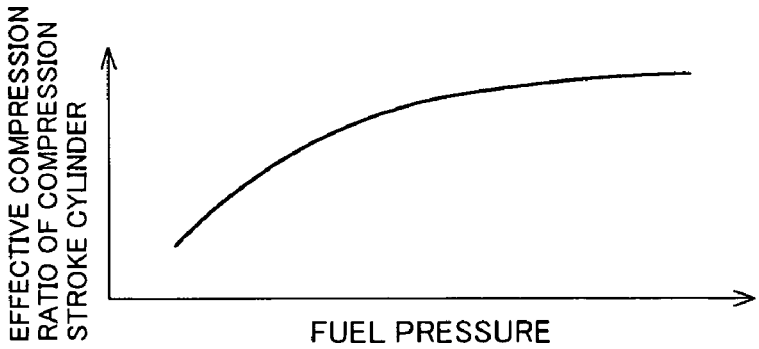
FIG. 6 is a graph showing an effective compression ratio of the compression stroke cylinder with respect to fuel pressure in the first and second embodiments of the present invention.
Figure 7:
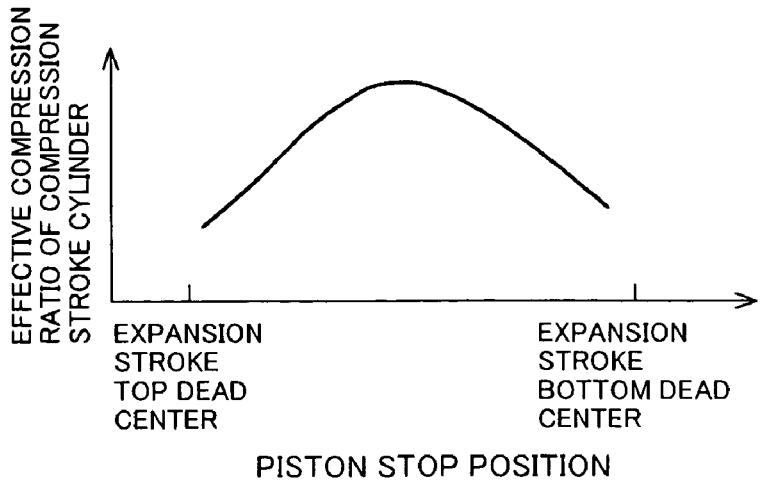
FIG. 7 is a graph showing an effective compression ratio of the compression stroke cylinder with respect to a piston stop position in the first and second embodiments of the present invention.
Figure 8:
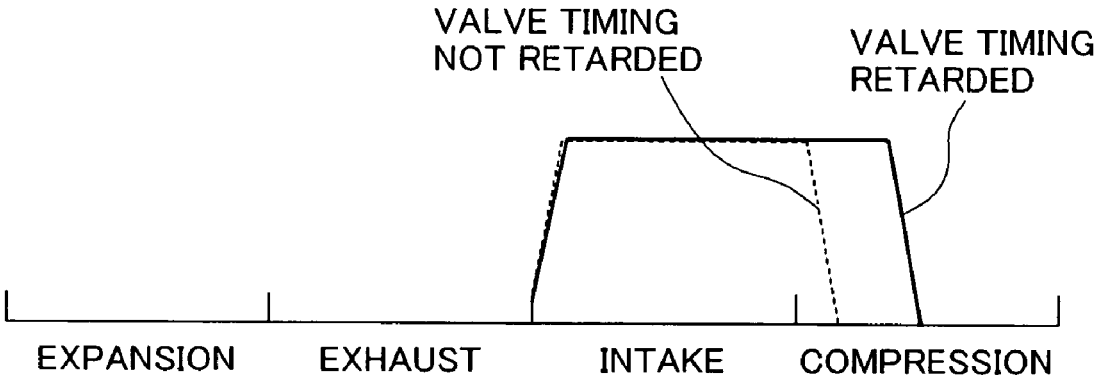
FIG. 8 is a chart showing the valve timing in the first embodiment of the present invention.

If it is determined in S210 that the starter is not to be operated, the effective compression ratio of the compression stroke cylinder is decided in S220 based on the piston position in the expansion stroke cylinder at restart. In addition to the piston position, the water temperature, the oil temperature and/or the fuel pressure may also be used to decide the effective compression ratio of the compression stroke cylinder. To decide the effective compression ratio of the compression stroke cylinder, mapping data of the effective compression ratio of the compression stroke cylinder with respect to the water temperature, the oil temperature, the fuel pressure, and the piston position at restart is stored in the form of respective maps in advance. The oil temperature may be derived from the water temperature. FIGS. 5, 6 and 7 show respectively the relationships of the effective compression ratio of the compression stroke cylinder versus the water temperature, the oil temperature and the piston stop position. In S220, the effective compression ratio of the compression stroke cylinder is decided based on each of the previously stored map and the corresponding sensor output. FIG. 8 shows the intake valve timing obtained in S220. By retarding the intake valve closing timing as shown in FIG. 8, the effective compression ratio of the compression stroke cylinder can be reduced and a starting load can be lessened. Further, since the effective compression ratio of the compression stroke cylinder is decided in S220 depending on the piston position in the expansion stroke cylinder at restart, it is possible to avoid an excessive reduction of the effective compression ratio in spite of any engine status at restart, and to improve controllability of the engine during a transient stage from initial to complete combustion. Then, the intake valve closing timing is varied in S230 in accordance with a command for operating the valve adjusting mechanism so that the effective compression ratio of the compression stroke cylinder decided in S220 is obtained. Alternatively, in S230, the intake valve timing in the intake stroke cylinder may be varied to be the same as that in the expansion stroke cylinder so that a plurality of expansion stroke cylinders are operated in synch to improve startability.

Then, in S240, the amount of fuel injected to one or plural expansion stroke cylinders is decided. The fuel injection amount is decided based on the piston position in the expansion stroke cylinder and the effective compression ratio of the compression stroke cylinder at restart. In addition to the piston position and the effective compression ratio of the compression stroke cylinder, the water temperature, the oil temperature and/or the fuel pressure may also be used to decide the fuel injection amount. In this embodiment, mapping data of the fuel injection amount with respect to the piston position, the water temperature, the oil temperature and the fuel pressure in the expansion stroke cylinder, as well as to the effective compression ratio of the compression stroke cylinder at restart is stored in the form of respective maps in advance. By using those maps, it is possible to select the optimum fuel injection amount, to improve startability, and to avoid deterioration of exhaust air caused by, e.g., adhesion of fuel mist to the piston.

After deciding the fuel injection amount in S240, a proportion at which the decided fuel injection amount is divided in plural injections is decided in S245. The divided injection is advantageous in shortening penetration of the fuel mist and avoiding adhesion of the fuel mist to a wall surface of the combustion chamber. In S245, the proportion of the fuel injection amount divided in the plural injections is decided based on at least one of the fuel injection amount and the piston position in the expansion stroke cylinder at restart. In addition to the piston position and the fuel injection amount, the water temperature, the oil temperature and/or the fuel pressure may also be used to decide the proportion of the fuel injection amount divided in the plural injections. In this embodiment, mapping data of the proportion of the fuel injection amount divided in the plural injections with respect to the water temperature, the oil temperature, the fuel injection amount, the fuel pressure, and the piston position in the expansion stroke cylinder at restart is stored in the form of respective maps in advance. With the fuel divided injection, it is possible to increase an air utilization rate of the fuel mist and to promote evaporation.

Then, in S250, a time interval from the fuel injection to the ignition is decided based on at least one of the fuel injection amount and the proportion of the fuel injection amount divided in the plural injections at restart. In addition to the fuel injection amount and the proportion of the fuel injection amount divided in the plural injections, the water temperature, the oil temperature and/or the fuel pressure may also be used to decide the time interval from the fuel injection to the ignition. In this embodiment, mapping data of the time interval from the fuel injection to the ignition with respect to the water temperature, the oil temperature, the fuel pressure, the fuel injection amount, and the proportion of the fuel injection amount divided in the plural injections at restart is stored in the form of respective maps in advance. Because an optimum value of the time interval from the fuel injection to the ignition depends on an evaporation characteristic of the fuel mist, fluidity in the cylinder induced by the fuel mist, and the air-fuel ratio around an ignition plug, it is preferably decided based on the water temperature, the oil temperature, the fuel pressure, the fuel injection amount, and/or the proportion of the fuel injection amount divided in the plural injections, which are highly sensitive to those properties. As a result, the optimum time interval from the fuel injection to the ignition can be selected corresponding to the engine status at restart, and starting torque can be increased.

While in this embodiment the fuel proportion divided in the plural injections is decided in S245, the divided injection is not necessarily required.

After deciding the effective compression ratio of the compression stroke cylinder, the amount of fuel injected to the expansion stroke cylinder, and the time interval from the fuel injection to the ignition as described above, commands for the fuel injection and the ignition are issued in S260 and S270, respectively. Then, an engine initial to complete combustion routine is started in S300.

The control flow executed by the control unit regarding the initial combustion and the starter operation at restart has been described above. Control flow executed by the control unit regarding the engine operation from the initial to complete combustion will be described below with reference to FIGS. 9 and 10.

Figure 9:
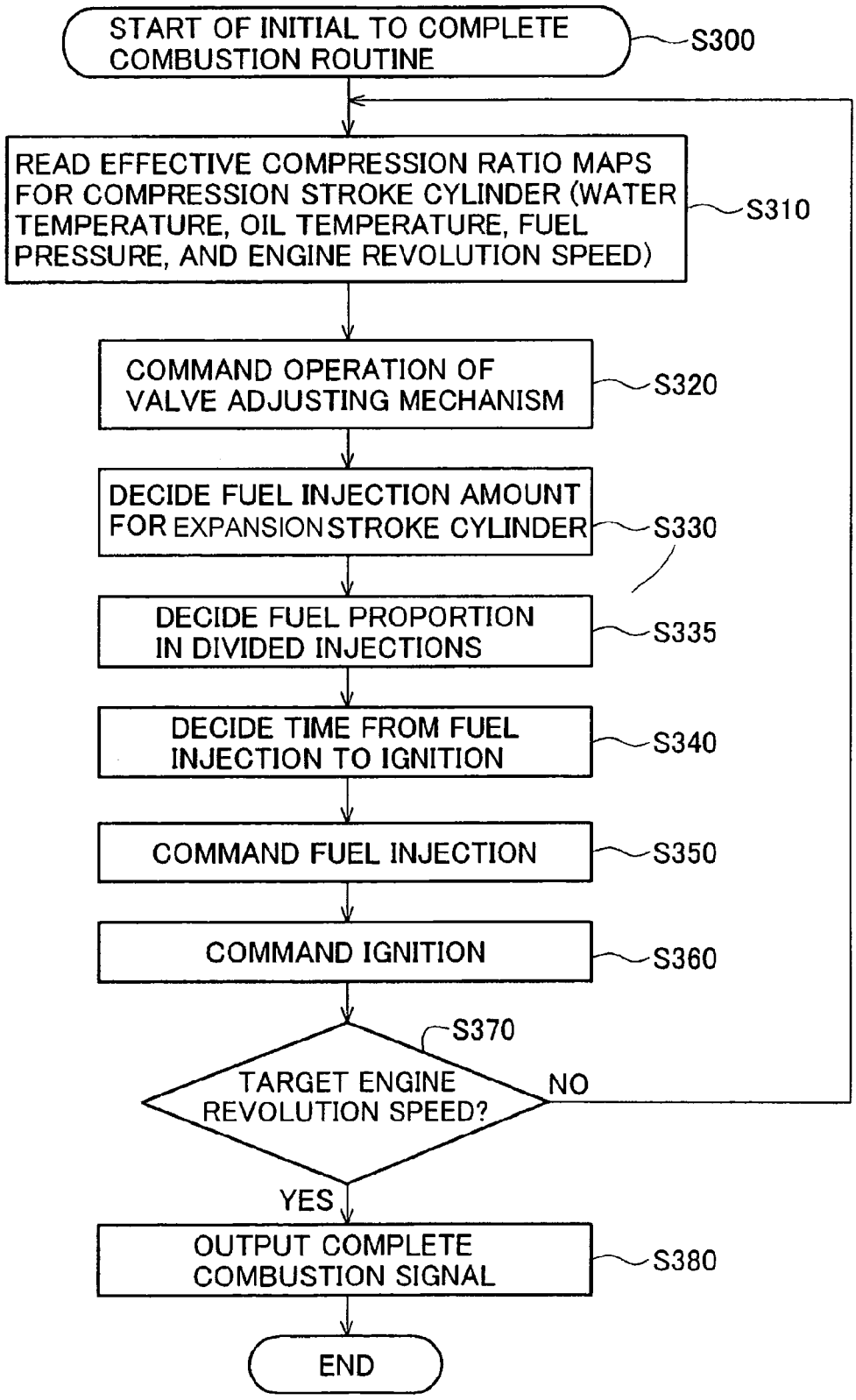
FIG. 9 is a chart showing a first pattern of control flow of an initial to complete combustion routine in the first embodiment of the present invention.

FIG. 9 shows a first pattern of the control flow executed by the control unit regarding the engine operation from the initial to complete combustion. The initial to complete combustion routine is started in S300, and the effective compression ratio of the compression stroke cylinder is decided in S310 based on the engine revolution speed during the transient stage from the initial to complete combustion. In addition to the engine revolution speed during the transient stage, the water temperature, the oil temperature and/or the fuel pressure may also be used to decide the effective compression ratio of the compression stroke cylinder. In this embodiment, mapping data of the effective compression ratio of the compression stroke cylinder with respect to the water temperature, the oil temperature, the fuel pressure, and the engine revolution speed during the transient stage from the initial to complete combustion at restart is stored in the form of respective maps in advance. Based on those maps, the command for varying the intake valve closing timing is issued in step S320. By varying the effective compression ratio of the compression stroke cylinder depending on the engine revolution speed, the engine status during the transient stage is fed back and the optimum fuel injection amount during the transient stage can be selected.

Then, in S330, the amount of fuel injected to the expansion stroke cylinder is decided. The fuel injection amount is decided based on at least one of the effective compression ratio of the compression stroke cylinder and the engine revolution speed at restart. In addition to the effective compression ratio of the compression stroke cylinder and the engine revolution speed at restart, the water temperature, the oil temperature and/or the fuel pressure may also be used to decide the fuel injection amount. In this embodiment, mapping data of the amount of fuel injected to the expansion stroke cylinder with respect to the piston position, the water temperature, the oil temperature and the fuel pressure in the expansion stroke cylinder, as well as to the effective compression ratio of the compression stroke cylinder at restart is stored in the form of respective maps in advance. By varying the fuel injection amount depending on the effective compression ratio of the compression stroke cylinder, the engine status during the transient stage is fed back and the optimum fuel injection amount during the transient stage can be selected.

For injecting the fuel in the amount, which has been decided in S330, to the expansion stroke cylinder in divided plural injections, a proportion at which the decided fuel injection amount is divided in the plural injections is decided in S335. The divided injection is advantageous in shortening penetration of the fuel mist and avoiding adhesion of the fuel mist to the wall surface of the combustion chamber. In S335, the proportion of the fuel injection amount divided in the plural injections is decided based on the fuel injection amount and the piston position in the expansion stroke cylinder at restart. In addition to the fuel injection amount and the piston position in the expansion stroke cylinder at restart, the water temperature, the oil temperature and/or the fuel pressure may also be used to decide the proportion of the fuel injection amount divided in the plural injections. In this embodiment, mapping data of the proportion of the fuel injection amount divided in the plural injections with respect to the water temperature, the oil temperature, the fuel injection amount, the fuel pressure, and the piston position in the expansion stroke cylinder at restart is stored in the form of respective maps in advance. With the fuel divided injection, it is possible to increase an air utilization rate of the fuel mist and to promote evaporation.

Then, in S340, a time interval from the fuel injection to the ignition is decided based on the fuel injection amount, the proportion of the fuel injection amount divided in the plural injections, and the engine revolution speed at restart. In addition to the fuel injection amount, the proportion of the fuel injection amount divided in the plural injections, and the engine revolution speed at restart, the water temperature, the oil temperature and/or the fuel pressure may also be used to decide the time interval from the fuel injection to the ignition. In this embodiment, mapping data of the time interval from the fuel injection to the ignition with respect to the water temperature, the oil temperature, the fuel pressure, the fuel injection amount, the proportion of the fuel injection amount divided in the plural injections, and the engine revolution speed at restart is stored in the form of respective maps in advance. By varying the time interval from the fuel injection to the ignition depending on the engine revolution speed and the fuel injection amount, the engine status during the transient stage is fed back and the optimum the time interval from the fuel injection to the ignition during the transient stage can be selected.

After deciding the fuel injection amount and the time interval from the fuel injection to the ignition as described above, commands for the fuel injection and the ignition are issued in S350 and S360, respectively.

Then, the control unit determines in S370 that the complete combustion has been obtained, if the engine revolution speed exceeds a target engine revolution speed. A complete combustion signal is outputted in S380, whereby the control flow at restart is brought to an end. If it is determined in S370 that the engine revolution speed does not exceed the target engine revolution speed, the control flow from S310 is repeated again.

As a modification, in addition to deciding in S310 the effective compression ratio of the compression stroke cylinder based on at least one of the water temperature, the oil temperature and the fuel pressure at restart, the mapping data may be prepared to set the effective compression ratio of the compression stroke cylinder such that the effective compression ratio of a cylinder under compression stroke at present is larger than the effective compression ratio of a cylinder which has been in the compression stroke in the preceding cycle. In such a case, the command for varying the intake valve closing timing is issued in S320 in accordance with the modified map.

Figure 10:
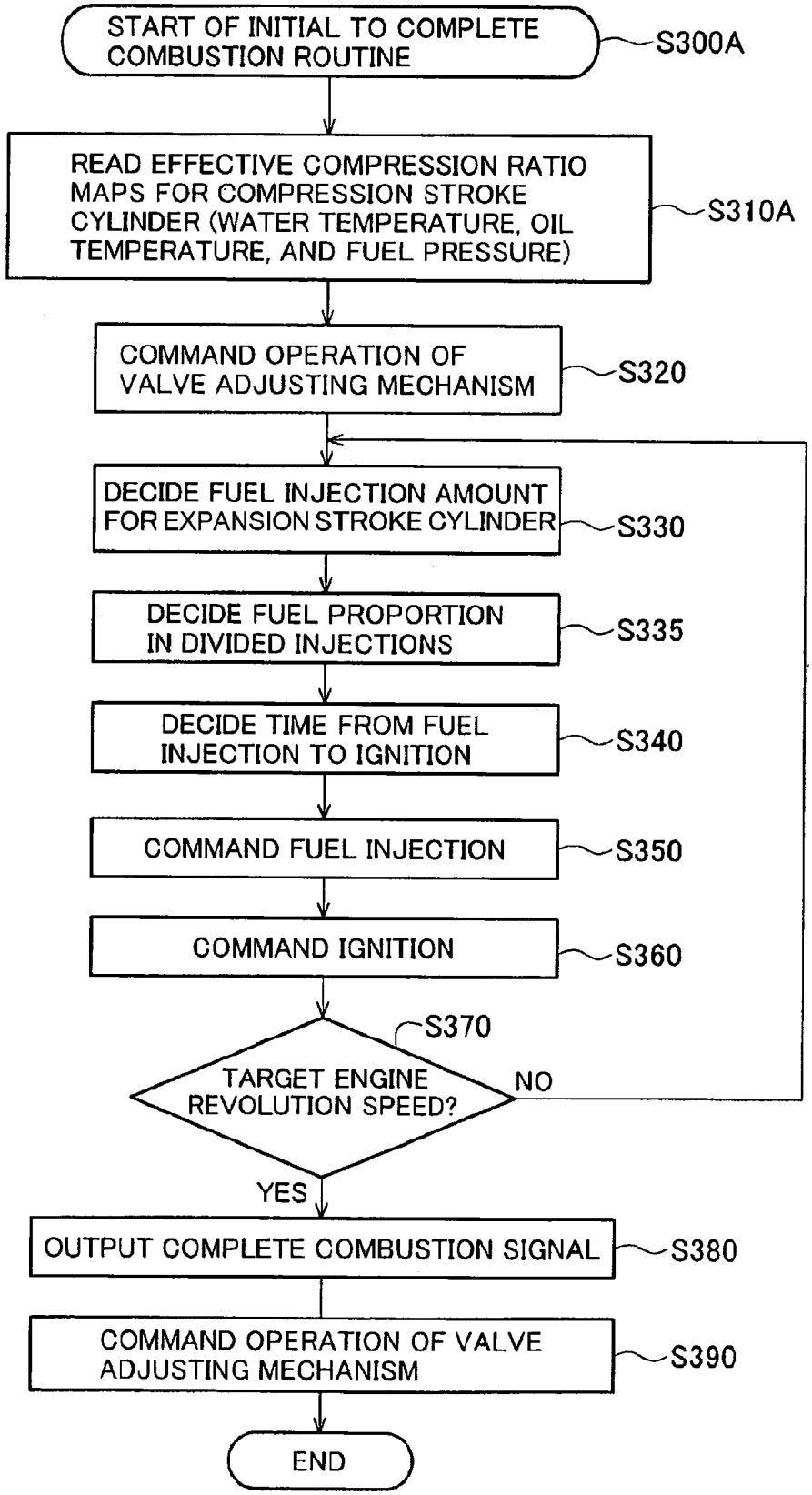
FIG. 10 is a chart showing a second pattern of control flow of the initial to complete combustion routine in the first embodiment of the present invention.

FIG. 10 shows a second pattern of the control flow of from the initial to complete combustion executed by the control unit. The initial to complete combustion routine is started in S300A, and the effective compression ratio of the compression stroke cylinder is decided in S310A based on at least one of the water temperature, the oil temperature, and the fuel pressure at restart. Mapping data of the effective compression ratio of the compression stroke cylinder with respect to the water temperature, the oil temperature, and the fuel pressure at restart is stored in the form of respective maps in advance. Based on those maps, the command for varying the intake valve closing timing is issued in S320. The control flow subsequent to S330 is the same as that in the first pattern of the control flow of from the initial to complete combustion, shown in FIG. 9, executed by the control unit. However, if it is determined in S370 that the complete combustion has not yet been obtained, the control flow is repeated again from S330. Thus, in the second pattern of the control flow of from the initial to complete combustion executed by the control unit, the effective compression ratio in the compression stroke is held constant until reaching the complete combustion, and the intake valve closing timing is varied to the valve closing timing for a stage after the complete combustion by a command for varying the intake valve closing timing, which is issued in S390 after issuance of a complete combustion signal.

If the operation of the starter is selected in S210 of FIG. 3, a starter operating routine is started in S400.

Figure 11:
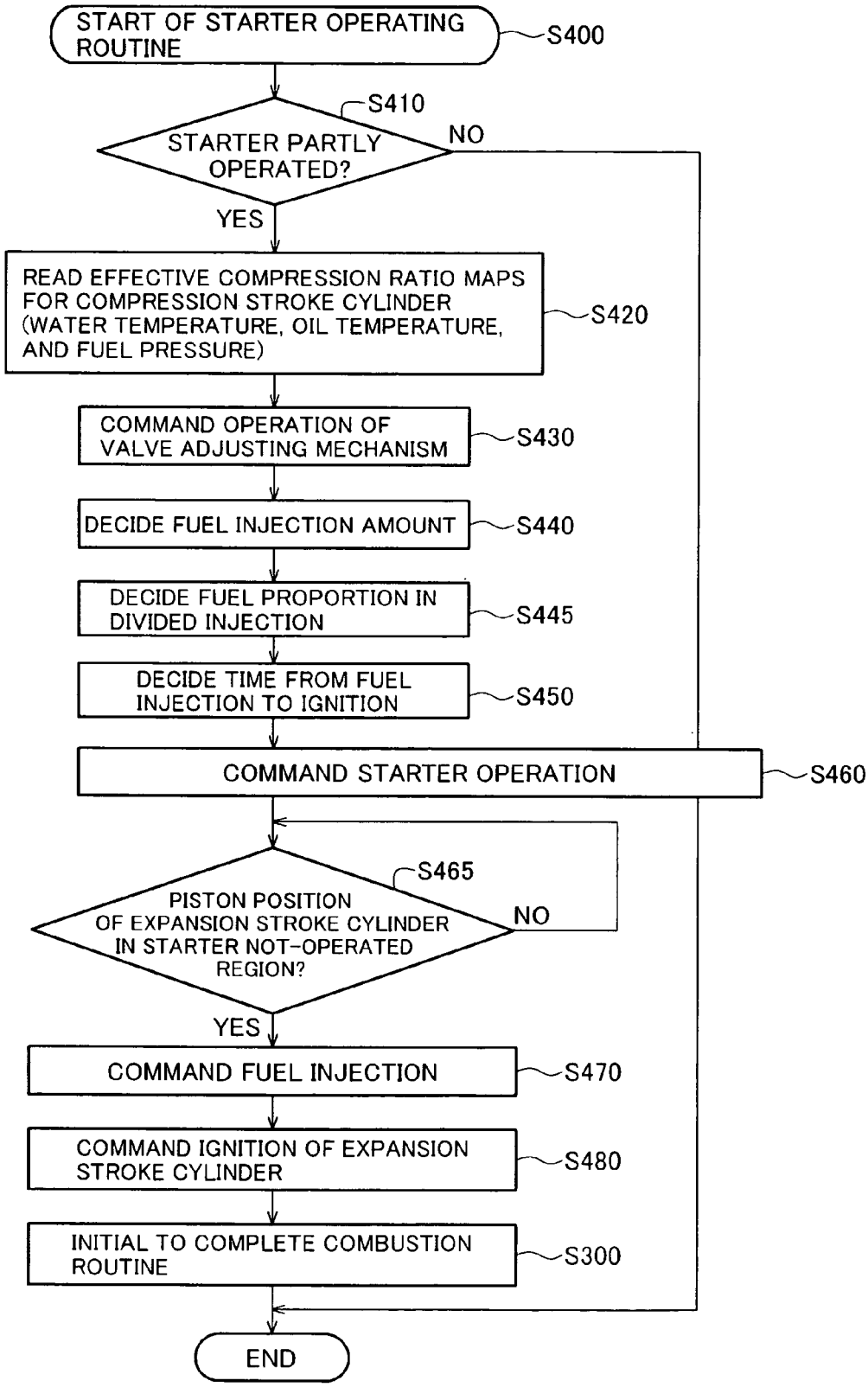
FIG. 11 is a chart showing control flow of a starter operating routine in the first embodiment of the present invention.

FIG. 11 shows control flow of the starter operating routine. The control unit determines in step S410 whether the starter is partly operated or not. More specifically, in S410, whether the starter is partly operated or the starter is entirely employed for restart is decided based on the water temperature, the oil temperature, and the fuel pressure when the engine is restarted. If the water temperature and the oil temperature are not higher than respective predetermined values, it is decided that the starter is entirely employed for restart. When the starter is partly operated, the starter is first operated to rotate the piston position in the expansion stroke cylinder so as to locate in the region, shown in FIG. 4, where the engine can restart with combustion. Then, the fuel injection and the ignition are performed in the expansion stroke cylinder for restart, to thereby reduce the load imposed on the starter. Steps subsequent to S420 represents control flow executed in the case of partly operating the starter. By first rotating the engine with the starter, it is possible to produce fluidity in the cylinder, to promote evaporation of fuel injected later, and to increase starting torque obtained with the combustion.

Subsequently, in S420, the effective compression ratio of the compression stroke cylinder is decided based on at least one of the water temperature, the oil temperature, and the fuel pressure at restart. Mapping data of the effective compression ratio of the compression stroke cylinder with respect to the water temperature, the oil temperature, and the fuel pressure at restart is stored in the form of respective maps in advance. In accordance with the effective compression ratio of the compression stroke cylinder thus decided in S420, a command for adjusting the intake valve closing timing is issued in S430.

Then, in S440, the amount of fuel injected to the expansion stroke cylinder is decided. The fuel injection amount is decided based on at least one of the water temperature, the oil temperature and the fuel pressure at restart. Mapping data of the amount of fuel injected to the expansion stroke cylinder with respect to the water temperature, the oil temperature and the fuel pressure at restart is stored in the form of respective maps in advance.

For injecting the fuel in the amount, which has been decided in S440, to the expansion stroke cylinder in divided plural injections, a proportion at which the decided fuel injection amount is divided in plural injections is decided in S445. More specifically, in S445, the proportion of the fuel injection amount divided in the plural injections is decided based on at least one of the water temperature, the oil temperature, the fuel injection amount, and the fuel pressure at restart. Mapping data of the proportion of the fuel injection amount divided in the plural injections with respect to the water temperature, the oil temperature, the fuel injection amount, the fuel pressure, and the piston position in the expansion stroke cylinder at restart is stored in the form of respective maps in advance. With the fuel divided injection, it is possible to increase an air utilization rate of the fuel mist and to promote evaporation.

Then, in S450, a time interval from the fuel injection to the ignition is decided based on at least one of the water temperature, the oil temperature, the fuel pressure, the fuel injection amount, and the proportion of the fuel injection amount divided in the plural injections at restart. Mapping data of the time interval from the fuel injection to the ignition with respect to the water temperature, the oil temperature, the fuel pressure, the fuel injection amount, and the proportion of the fuel injection amount divided in the plural injections at restart is stored in the form of respective maps in advance. Because an optimum value of the time interval from the fuel injection to the ignition depends on an evaporation characteristic of the fuel mist, fluidity in the cylinder induced by the fuel mist, and the air-fuel ratio around the ignition plug, it is preferably decided based on the water temperature, the oil temperature, the fuel pressure, the fuel injection amount, and/or the proportion of the fuel injection amount divided in the plural injections, which are highly sensitive to those properties. As a result, the optimum time interval from the fuel injection to the ignition can be selected corresponding to the engine status at restart, and starting torque can be increased.

Then, in S460, a starter operating command is issued in S460 to restart the engine. At this time, after starting the starter, the control unit determines in S465 whether the piston position in the expansion stroke cylinder reaches a position in the region, shown in FIG. 4, where the engine can restart with combustion. Subsequently, the fuel injection to at least one of the expansion, intake and compression stroke cylinders and the ignition in the expansion stroke cylinder are commanded in S470 and S480, respectively. The control unit then proceeds to S300 for executing the initial to complete combustion routine, i.e., the control flow of from the initial to complete combustion.

If it is determined in S410 that the starter is not partly operated, the starter is entirely operated for restart in S460, whereby the starter operating routine is brought to an end.

While in this embodiment the fuel proportion divided in the plural injections is decided in S445, the divided injection is not necessarily required.

Second Embodiment

A second embodiment of the present invention will be described below with reference to FIG. 12.

Figure 12:
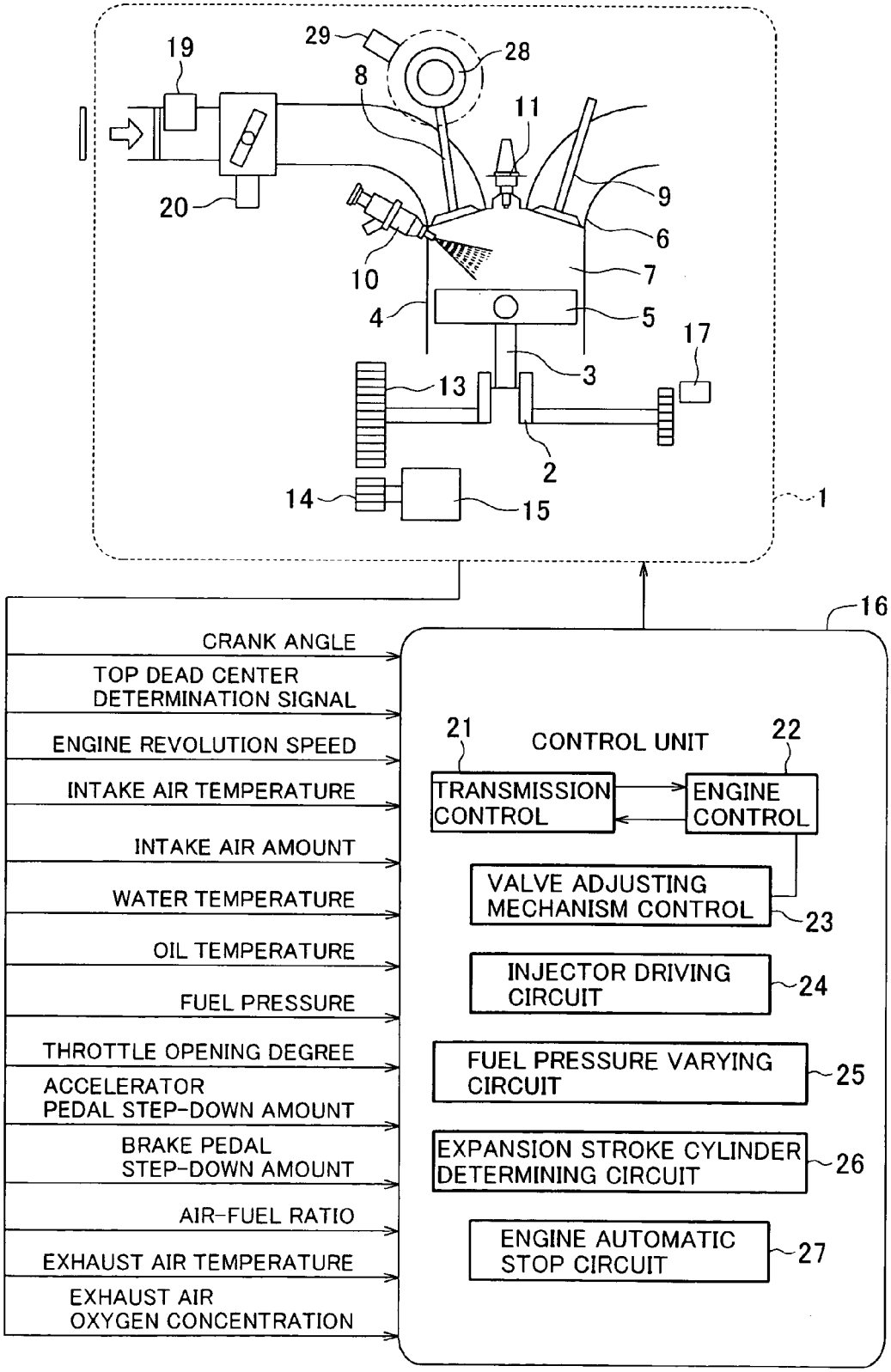
FIG. 12 is a system diagram of an internal combustion engine according to a second embodiment of the present invention.

FIG. 12 is a system diagram of an in-cylinder direct injection internal combustion engine according to the second embodiment of the present invention. The construction of this second embodiment of the present invention, shown in FIG. 12, differs from that of the first embodiment, shown in FIG. 1, in including a top dead center determining sensor 18, a hydraulically-driven valve adjusting mechanism 28 capable of varying the intake valve closing timing, and a cylinder determining sensor 29. The remaining construction is the same.

The hydraulically-driven valve adjusting mechanism 28 is able to advance and retard the phase of timing of closing the intake valve 8 within a predetermined range. This phase varying operation is performed by switching supply and drain lines of a hydraulic fluid, which are provided in the hydraulically-driven valve adjusting mechanism 28.

The timings of fuel injection and ignition for each cylinder are controlled by the control unit 16. The fuel injection valve 10 and the spark igniter 11, described above, are driven respectively by an injection pulse signal and an ignition signal outputted from the control unit 16. The injection pulse signal and the ignition signal are obtained from respective outputs of the crank angle sensor 17 and the cylinder determining sensor 29, both associated with the engine 1, through processing in the control unit 16, and they properly control the timings of fuel injection and ignition. In consideration of backward rotation of the crankshaft caused upon stop of the engine, the crank angle sensor 17 preferably has the function of measuring a rotational angle of the crankshaft in both forward and backward directions like a resolver that is capable of measuring an absolute angle of the crankshaft. Also, in this second embodiment of the present invention, the crankshaft angle is measured as follows. The control unit 16 counts and stores the crank angle signals during a period between two output signals from the cylinder determining sensor 29. Based on those crank angle signals, the stroke and the piston position can be determined for each cylinder. Further, when the engine is stopped, it is possible to determine the stroke of the particular cylinder and the piston stop position therein at that time by storing the stroke of each cylinder with the stroke determining means provided for each cylinder just before stop of the engine.

The operation of this embodiment will be described below.

Figure 13:
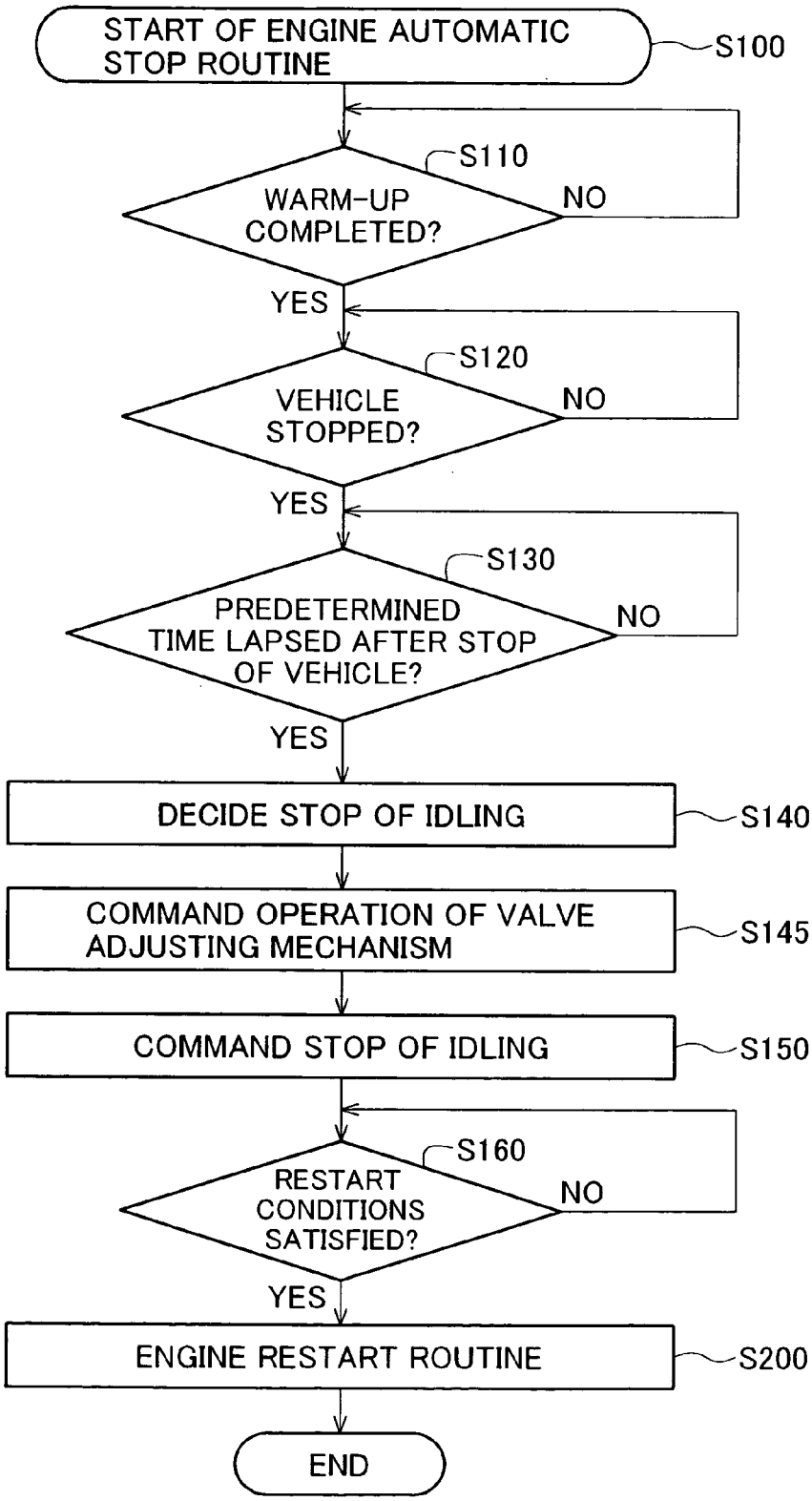
FIG. 13 is a chart showing control flow of an engine automatic stop routine in the second embodiment of the present invention.
Figure 14:
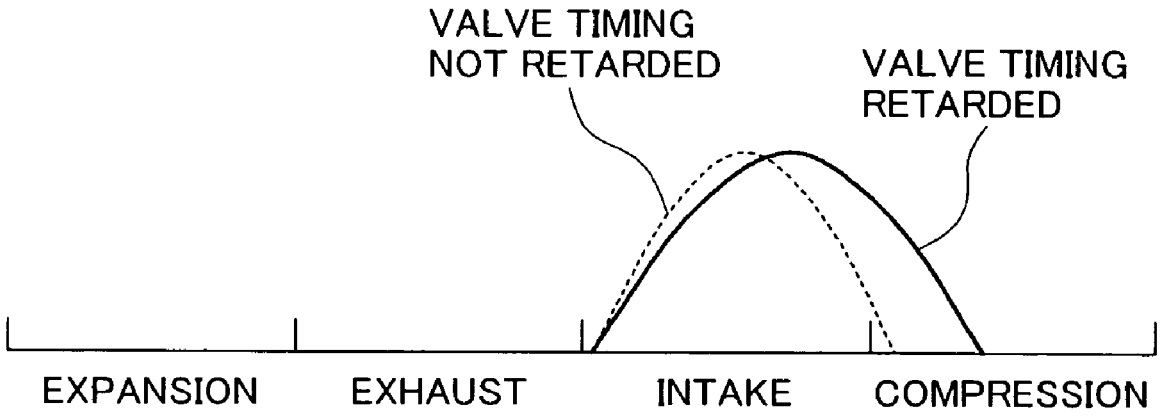
FIG. 14 is a chart showing the valve timing in the second embodiment of the present invention.

FIG. 13 shows control flow of an engine automatic stop routine. The control unit determines in S110 whether warm-up of the engine is completed. In this embodiment, when the water temperature is not lower than 80° C., the control unit determines that the warm-up is completed, and when the water temperature is lower than 80° C., it determines that the engine is in a cold state. However, the temperature used in the determination may be set to any other suitable value. If it is determined in S110 that the warm-up is completed, the control unit determines in S120 whether the relevant vehicle is stopped. If the vehicle is stopped, the control unit determines in S130 whether a predetermined time has lapsed from the stop of the vehicle. If the predetermined time has lapsed from the stop of the vehicle, stop of idling is decided in S140. In this embodiment, a command for operating the valve adjusting mechanism is issued in S145 just before the engine stop to control the intake valve closing timing so as to provide a preset certain effective compression ratio. This control is capable of avoiding a trouble that the valve adjusting mechanism fails to operate due to a lowering of hydraulic pressure caused after the engine stop. FIG. 14 shows one example of the preset intake valve timing. By retarding the intake valve closing timing as shown in FIG. 14, the effective compression ratio of the compression stroke cylinder can be reduced and a starting load can be lessened. As a result, it is possible to avoid an excessive reduction of the effective compression ratio with respect to the engine status at restart, and to improve controllability of the engine in the transient stage of from the initial to complete combustion. In S150, the stop of idling is commanded. After the stop of idling has been commanded in S150 and the command of the fuel injection or the ignition for an optionally selected cylinder has ceased, the piston stop position may be feedback-controlled to a desired position by driving an auxiliary, e.g., an air conditioner, an alternator or a defroster. Further, any other mechanism capable of mechanically stopping the crankshaft may also be used. Even in the case where, after the engine stop, the vehicle is moved by motive power obtained from a power source other than the engine and the crank stop position is shifted, because electric power is continuously supplied to the control unit 16 during the stop of idling, the crank position can be determined. Then, before engine restart conditions are satisfied, the fuel injection may be performed in the expansion stroke cylinder that is detected by the above-mentioned stroke determining means associated with the optionally selected cylinder. Such fuel injection is advantageous in that fuel is sufficiently evaporated within the combustion chamber at restart of the engine and therefore a more homogeneous fuel-air mixture can be formed. As a result, startability can be improved. Any other suitable condition may be added to the conditions used for deciding the stop of idling. If it is determined in S160 after the engine stop that the restart conditions are satisfied, an engine restart routine is started in S200.

Control flow of the engine restart routine in the second embodiment of the present invention will be described below with reference to FIG. 15. The control flow in this second embodiment is basically the same as that in the first embodiment, shown in FIG. 3, except for the following points. Since this second embodiment has a possibility that the valve adjusting mechanism cannot be operated to vary the valve timing after the engine stop, the steps of S220 and S230 in FIG. 3 are omitted. Further, maps for the effective compression ratio are not prepared in the steps subsequent to S240.

Figure 15:
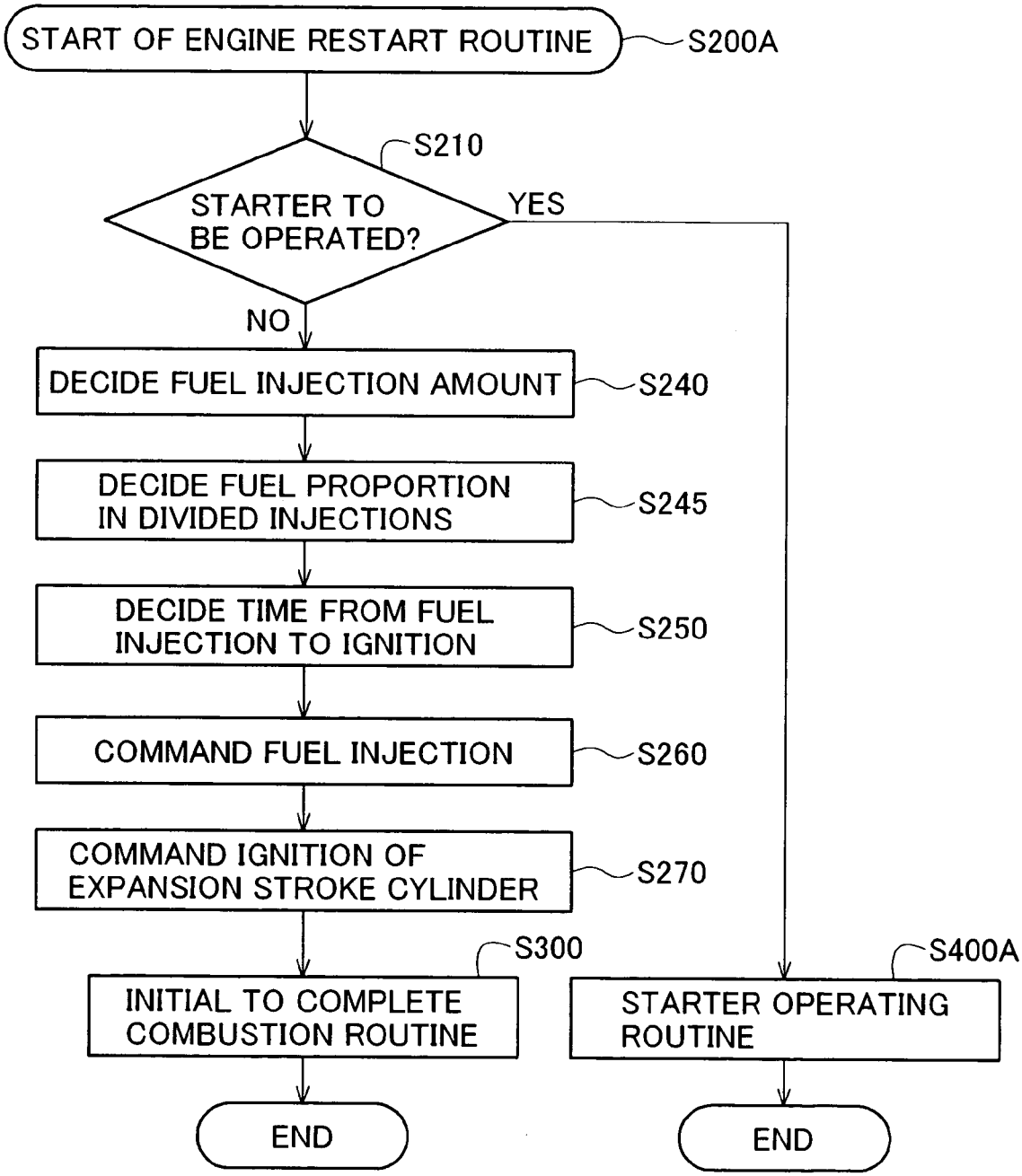
FIG. 15 is a chart showing control flow of an engine restart routine in the second embodiment of the present invention.
Figure 16:
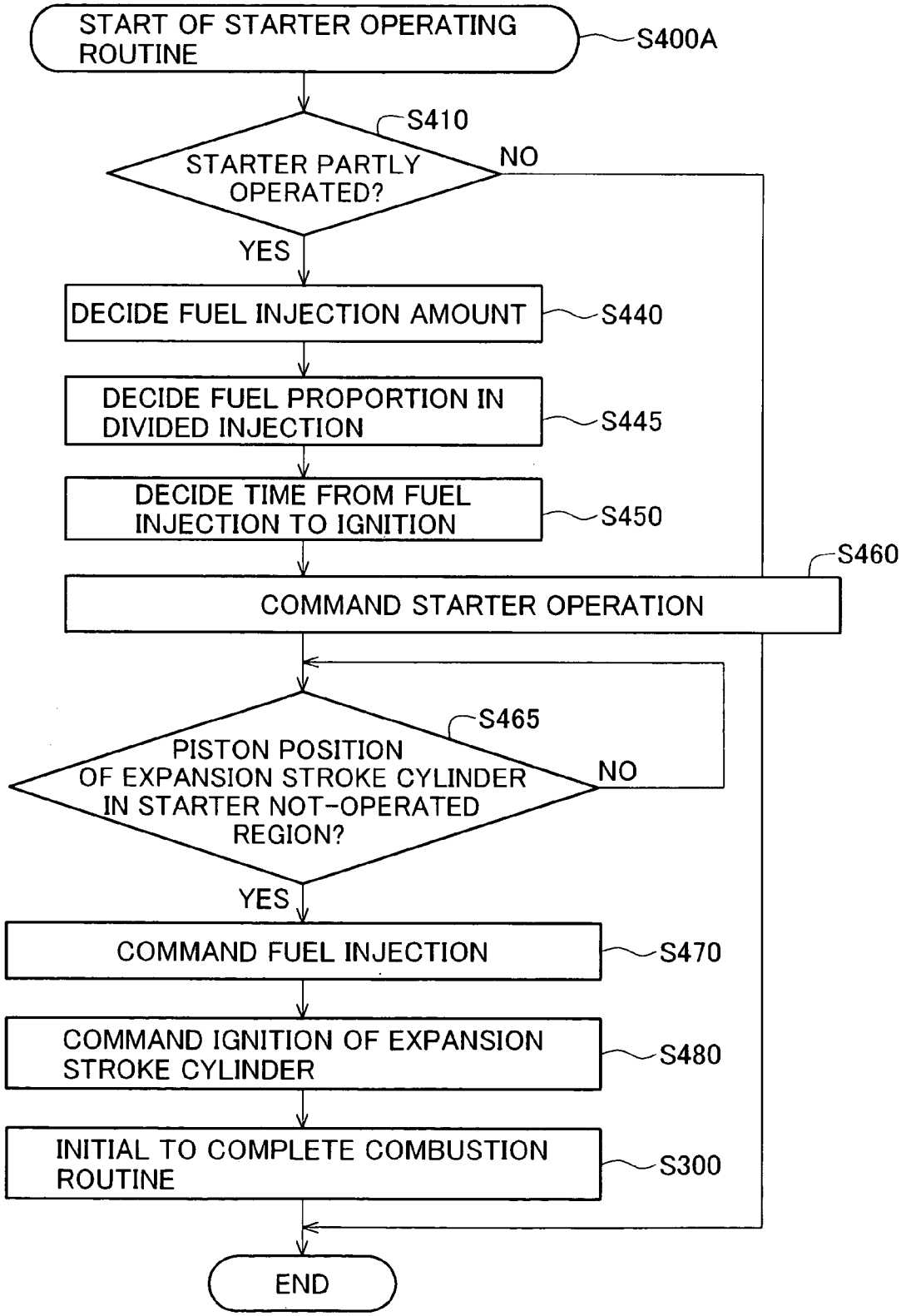
FIG. 16 is a chart showing control flow of a starter operating routine in the second embodiment of the present invention.

If the operation of the starter is selected in S210 of FIG. 15, a starter operating routine shown in FIG. 16 is started in S400A. Control flow of the starter operating routine in this second embodiment is basically the same as that in the first embodiment, shown in FIG. 11, except for the following points. Since this second embodiment has a possibility that the valve adjusting mechanism cannot be operated to vary the valve timing after the engine stop, the step of S430 in FIG. 11 is omitted. Further, maps for the effective compression ratio are not prepared in the steps subsequent to S440.

What is claimed is:

1. An internal combustion engine restart method, comprising determining an amount of fuel injection to an engine cylinder under expansion stroke in accordance with environment parameters at engine restart, and determining a time interval from a fuel injection time to an ignition time, a dividing ratio of the amount of fuel injection, a choice of whether fuel is or is not injected in a divided way, or a time of divided fuel injection.

2. An internal combustion engine restart method according to claim 1, wherein said environment parameters at engine restart is at least one of a water temperature, an oil temperature, a fuel pressure, a piston stop position, a battery remaining level, a piston position in the cylinder under an expansion stroke, and engine revolution speed.

3. An internal combustion control method according to claim 1, wherein, when an internal combustion engine is restarted, the timing of closing an intake valve of a cylinder under compression stroke is variably adjusted so that compression work performed by the cylinder under compression stroke is smaller than combustion work performed by a cylinder under expansion stroke.

4. An internal combustion engine control method according to claim 1, wherein said internal combustion engine comprises a mechanism capable of varying at least the intake valve closing timing; means for determining the cylinder that is under expansion stroke at engine restart; and means for determining, at least when said engine is restarted, a piston stop position in the cylinder under expansion stroke, which is determined by said means for determining the cylinder that is under expansion stroke at engine restart, wherein said control method comprises performing, when said engine is restarted, fuel injection and ignition in the cylinder under expansion stroke, which is determined by said means for determining the cylinder that is under expansion stroke at engine restart; and controlling the intake valve closing timing of the cylinder under compression stroke by said intake valve closing-timing varying mechanism so that compression work performed by the cylinder under compression stroke is smaller than combustion work performed by the cylinder under expansion stroke.

5. An internal combustion engine control method according to claim 1, wherein said control method further comprises keeping constant the effective compression ratio of the cylinder under compression stroke and making the effective compression ratio variable after outputting of a complete combustion signal when said engine is restarted.

6. An internal combustion engine control method or an internal combustion engine which comprises a mechanism capable of varying at least the intake valve closing timing;

means for determining the cylinder that is under expansion stroke at engine restart; and means for determining, at least when said engine is restarted, a piston stop position in the cylinder under expansion stroke, which is determined by said means for determining the cylinder that is under expansion stroke at engine restart, and wherein said control method comprises the steps of:

performing, when said engine is restarted, fuel injection and ignition in the cylinder under expansion stroke, which is determined by said means for determining the cylinder that is under expansion stroke at engine restart; and controlling the intake valve closing timing of the cylinder under compression stroke by said intake valve closing-timing varying mechanism so that compression work performed by the cylinder under compression stroke is smaller than combustion work performed by the cylinder under expansion stroke wherein when an internal combustion engine is restarted, the timing of closing an intake valve of a cylinder under compression stroke is variably adjusted so that compression work performed by the cylinder under compression stroke is smaller than combustion work performed by a cylinder under expansion stroke previously setting the effective compression ratio to different values depending on the piston stop position in the cylinder under expansion stroke, which is determined by said means for determining a piston stop position in the cylinder under expansion stroke, and reducing the effective compression ratio of the cylinder under compression stroke by said intake valve closing-timing varying mechanism in accordance with the set values of the effective compression ratio.

7. An internal combustion engine control method according to claim 6, wherein fuel injection is performed in the cylinder under expansion stroke during from stop to restart of said engine.

8. An internal combustion engine control method according to claim 6, wherein said internal combustion engine further comprises a mechanism capable of freely varying the intake valve opening timing, the exhaust valve opening timing, and the exhaust valve closing timing for each cylinder, and bringing a plurality of cylinders into expansion stroke by said mechanisms capable of freely varying the intake-and-exhaust valve opening and closing timings; and performing fuel injection and ignition in the cylinder under expansion stroke, which is determined by said means for determining the cylinder that is under expansion stroke at engine restart.

9. An internal combustion engine control method according to claim 6, wherein said control method further comprises the step of reducing an effective compression ratio of the cylinder under compression stroke by said intake valve closing-timing varying mechanism prior to engine restart.

10. An internal combustion engine control method according to claim 6, wherein said control method further comprises the step of controlling the effective compression ratio of the cylinder under compression stroke to be larger than the effective compression ratio of the preceding cylinder when said engine is restarted.

11. An internal combustion engine control method according to claim 6, wherein said control method further comprises the step of keeping constant the effective compression ratio of the cylinder under compression stroke and making the effective compression ratio variable after outputting of a complete combustion signal when said engine is restarted.

12. An internal combustion engine control method for an internal combustion engine which comprises a mechanism capable of varying at least the intake valve closing timing;

means for determining the cylinder that is under expansion stroke at engine restart; and means for determining, at least when said engine is restarted, a piston stop position in the cylinder under expansion stroke, which is determined by said means for determining the cylinder that is under expansion stroke at engine restart, and wherein said control method comprises the steps of:

performing, when said engine is restarted, fuel injection and ignition in the cylinder under expansion stroke, which is determined by said means for determining the cylinder that is under expansion stroke at engine restart; and controlling the intake valve closing timing of the cylinder under compression stroke by said intake valve closing-timing varying mechanism so that compression work performed by the cylinder under compression stroke is smaller than combustion work performed by the cylinder under expansion stroke, wherein when an internal combustion engine is restarted, the timing of closing an intake valve of a cylinder under compression stroke is variably adjusted so that compression work performed by the cylinder under compression stroke is smaller than combustion work performed by a cylinder under expansion stroke controlling the effective compression ratio of the cylinder under compression stroke in accordance with an engine revolution speed when said engine is restarted.

13. An internal combustion engine restart method according to claim 1, wherein a time interval from fuel injection to ignition is decided based on the fuel injection amount or a proportion of the fuel injection amount divided into plural injections at engine restart.

14. An internal combustion engine restart method for an internal engine which comprises, a mechanism capable of varying at least the intake valve closing timing;

means for determining the cylinder that is under expansion stroke at engine restart; and means for determining, at least when said engine is restarted, a piston stop position in the cylinder under expansion stroke, which is determined by said means for determining the cylinder that is under expansion stroke at engine restart, and wherein said control method comprises the steps of:

performing, when said engine is restarted, fuel injection and ignition in the cylinder under expansion stroke, which is determined by said means for determining the cylinder that is under expansion stroke at engine restart; and controlling the intake valve closing timing of the cylinder under compression stroke by said intake valve closing-timing varying mechanism so that compression work performed by the cylinder under compression stroke is smaller than combustion work performed by the cylinder under expansion stroke, comprising judging, when an engine is restarted, whether to inject fuel to an engine cylinder under expansion stroke in a divided way or together with in accordance with environment parameters at engine restart, an controlling the engine, wherein when an internal combustion engine is restarted, the timing of closing an intake valve of a cylinder under compression stroke is variably adjusted so that compression work performed by the cylinder under compression stroke is smaller than combustion work performed by a cylinder under expansion stroke.

15. An internal combustion engine restart method according to claim 14, wherein fuel injection is performed in the cylinder under expansion stroke during from stop to restart of said engine.

16. An internal combustion engine restart method according to claim 14, wherein said internal combustion engine further comprises a mechanism capable of freely varying the intake valve opening timing, the exhaust valve opening timing, and the exhaust valve closing timing for each cylinder, and bringing a plurality of cylinders into expansion stroke by said mechanisms capable of freely varying the intake-and-exhaust valve opening and closing timings; and performing fuel injection and ignition in the cylinder under expansion stroke, which is determined by said means for determining the cylinder that is under expansion stroke at engine restart.

17. An internal combustion engine restart method according to claim 14, wherein said control method further comprises the step of reducing an effective compression ratio of the cylinder under compression stroke by said intake valve closing-timing varying mechanism prior to engine restart.

18. An internal combustion engine restart method according to claim 14, wherein said control method further comprises the step of controlling the effective compression ratio of the cylinder under compression stroke to be larger than the effective compression ratio of the preceding cylinder when said engine is restarted.

19. An internal combustion engine control method for an internal combustion engine which comprises a mechanism capable of varying at least the intake valve closing timing; and means for determining the cylinder that is under expansion stroke at engine restart, wherein said control method comprises performing, when said engine is restarted, fuel injection and ignition in the cylinder under expansion stroke, which is determined by said means for determining the cylinder that is under expansion stroke at engine restart; and wherein said internal combustion engine further comprises a mechanism capable of freely varying the intake valve opening timing, the exhaust valve opening timing, and the exhaust valve closing timing for each cylinder, and bringing a plurality of cylinders that are in other than expansion stroke into expansion stroke by said mechanisms capable of freely varying the intake-and-exhaust valve opening and closing timings; and performing fuel injection and ignition in the cylinder under expansion stroke, which is determined by said means for determining the cylinder that is under expansion stroke at engine restart.

20. An internal combustion engine control method for internal combustion engine according to claim 19, wherein said internal combustion engine comprises means for determining, at least when said engine is restarted, a piston stop position in the cylinder under expansion stroke, which is determined by said means for determining the cylinder that is under expansion stroke at engine restart, and wherein said control method further comprises determining an effective compression ratio of the cylinder under compression stroke in accordance with environment parameters at engine, restart which includes said piston stop position in the cylinder under expansion stroke determined by said piston stop position determining means.

21. An internal combustion engine control method for internal combustion engine according to claim 19, wherein said control method further comprises the controlling the intake valve closing timing to the cylinder under compression stroke by said intake valve-closing timing varying mechanism so that compression work performed by the cylinder under compression stroke is smaller than combustion work performed by the cylinder under compression stroke.

22. An internal combustion engine control method for internal combustion engine according to claim 19, wherein, said control method further comprises bringing a cylinder under intakes stroke into expansion stroke by said mechanisms capable of freely adjusting the intake valve opening and closing timing of the intake stroke cylinder with the intake valve opening and closing timing of the expansion stroke cylinder.

23. An internal combustion engine control method for internal combustion engine according to claim 19, wherein said internal combustion engine further comprises means for determining, at least when said engine is restarted, a piston stop position in the cylinder under expansion stroke, which is determined by said means for determining the cylinder that is under expansion stroke at engine restart, and wherein said control method further comprises determining fuel amount injected into the cylinder under compression stroke in accordance with environment parameters at engine restart, which includes said piston stop position in the cylinder under expansion stroke determined by said piston stop piston determining means.

24. An internal combustion engine control method for internal combustion engine according to claim 19, wherein said control method further comprises determining a dividing ratio of compression stroke in accordance with environment parameters at engine restart, which includes said fuel amount injected into the cylinder under compression stroke.

* * * * *

UNITED STATES PATENT AND TRADEMARK OFFICE

CERTIFICATE OF CORRECTION

PATENT NO. : 7,258,099 B2
APPLICATION NO. : 10/920252
DATED : August 21, 2007
INVENTOR(S) : Takashi Yoshida et al.

It is certified that error appears in the above-identified patent and that said Letters Patent is hereby corrected as shown below:

On the title page, item [75] should read:

(75) Inventors: Takashi Yoshida, Hitachi (JP); Toshiharu Nogi, Hitachinaka (JP); Noboru Tokuyasu, Hitachinaka (JP)

Signed and Sealed this

Thirteenth Day of November, 2007

JON W. DUDAS
*Director of the United States Patent and Trademark Office*